US009072122B2

(12) United States Patent
Shimizu et al.

(10) Patent No.: US 9,072,122 B2
(45) Date of Patent: Jun. 30, 2015

(54) HEATING APPARATUS FOR HEATING A TONER IMAGE AND IMAGE FORMING APPARATUS INCLUDING THE SAME

(71) Applicant: CANON KABUSHIKI KAISHA, Tokyo (JP)

(72) Inventors: Hisae Shimizu, Tokyo (JP); Isao Hayashi, Kawasaki (JP); Masaaki Naoi, Yokosuka (JP); Hisatoshi Baba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/272,706

(22) Filed: May 8, 2014

(65) Prior Publication Data

US 2014/0348524 A1 Nov. 27, 2014

(30) Foreign Application Priority Data

May 22, 2013 (JP) ..... 2013-108370

(51) Int. Cl.
*G03G 15/20* (2006.01)
*H05B 1/02* (2006.01)

(52) U.S. Cl.
CPC ..... *H05B 1/0241* (2013.01); *G03G 15/2053* (2013.01)

(58) Field of Classification Search
CPC ..... G03G 15/2039; G03G 15/2053; H05B 1/2041
See application file for complete search history.

(56) References Cited

U.S. PATENT DOCUMENTS

| | | | | |
|---|---|---|---|---|
| 2002/0148828 | A1* | 10/2002 | Nagahira | 219/619 |
| 2013/0195494 | A1* | 8/2013 | Asami et al. | 399/70 |
| 2014/0153980 | A1 | 6/2014 | Kiyama et al. | |
| 2014/0193170 | A1 | 7/2014 | Fukasaka et al. | |

FOREIGN PATENT DOCUMENTS

| | | | |
|---|---|---|---|
| JP | 2002-123113 | A | 4/2002 |
| JP | 2012-78453 | A | 4/2012 |

* cited by examiner

*Primary Examiner* — Clayton E Laballe
*Assistant Examiner* — Noam Reisner
(74) *Attorney, Agent, or Firm* — Fitzpatrick, Cella, Harper & Scinto

(57) ABSTRACT

A non-contact power supply unit including a secondary coil supplies an alternating voltage to multiple heat generation layers provided in a heat generation film. In one of the heat generation layers, a loop is provided as a variable impedance circuit in which the impedance changes according to the frequency. A capacitance element in which the impedance changes according to the frequency is provided in the loop. The heat generation amounts of the heat generation layers are switched by changing the frequency of the alternating voltage generated in the secondary coil according to the size of the recording material that is the heating target.

9 Claims, 13 Drawing Sheets

| SIZE INFORMATION | FREQUENCY |
|---|---|
| B4 | 20kHz |
| A4 | 200kHz |

HEATING APPARATUS FOR HEATING A TONER IMAGE AND IMAGE FORMING APPARATUS INCLUDING THE SAME

BACKGROUND OF THE INVENTION

1. Field of the Invention

The present invention relates to a heating apparatus for heating a toner image and an image forming apparatus including the same.

2. Description of the Related Art

Film-heating type fixing apparatuses are known as fixing apparatuses that fix a toner image formed on a recording material. Heating is performed by applying a current to a heat generation layer provided in a fixing film, thereby prompting the fixing of the toner. Examples of methods for supplying current to a heat generation layer include a contact power supply method in which a power supply unit and a heat generation layer are in contact with each other, and a non-contact power supply method in which the power supply unit and the heat generation layer are not in contact with each other.

The contact power supply method is a method of supplying power by bringing a brush electrode into contact with a ring-shaped electrode attached to the inner circumferential face of a cylinder-shaped fixing film. With the contact power supply method, the power supply sometimes destabilizes due to wearing in the electrodes caused by rubbing. Also, since several hundred Watts to 1 kiloWatt of power is needed for fixing, electrical discharge sometimes occurs between the electrodes. An oxide layer formed by this electrical discharge sometimes destabilizes the power supply as well.

On the other hand, with the non-contact power supply method (Japanese Patent Laid-Open No. 2002-123113), power is supplied from a primary coil to a secondary coil by magnetically coupling the primary coil and the secondary coil. Accordingly, with the non-contact power supply method, wearing of the electrodes and the oxide layer are not generated in principle, and therefore it is possible to supply power more stably than in the contact power supply method.

Incidentally, the fixing apparatus fixes a toner image not only to a recording material that is wide in the width direction that is orthogonal to the conveyance direction, but also to a recording material that is narrow in the width direction. If recording materials with narrow widths are successively passed through the fixing apparatus, portions of the fixing film that do not come into contact with the recording material (non-paper-feeding regions) are likely to increase in temperature. If wide recording materials are fed through in this state, a high temperature offset is generated and wrinkling occurs in the ends of the recording materials. High temperature offsets cause image unevenness. Furthermore, there is also a risk that only the ends of the fixing film will exceed the heat resistant temperature.

Japanese Patent Laid-Open No. 2012-78453 proposes a fixing apparatus that heats only portions that correspond to the sheet size. Three pairs of electrodes are arranged on one heat generation layer at three different positions in the lengthwise direction. The three electrode pairs correspond to three types of sheet sizes. The electrode pair that is energized is switched by a switch in accordance with the size of the sheet being fed (FIG. 3, paragraph 0049 and the like). The distance from one of the electrodes constituting an electrode pair to the other electrode is designed in accordance with the size of the sheet.

Japanese Patent Laid-Open No. 2012-78453 does not disclose any power supply method. If a non-contact power supply method is employed, a switch for selecting the desired electrode pair out of the multiple electrode pairs will be needed on the secondary coil side. The current that flows in the heat generation body instantly reaches 10 [A]. If the switch on the secondary side is a mechanical switch, the switch needs to have a large size. This means increasing the rotation load for the rotating secondary side.

In the case of using an electronic switch on the secondary side, various circuits are needed. Specifically, a switch element such as a triac is needed between the secondary coil and the heat generation body, and a light receiving element that receives a wireless signal is also needed. Furthermore, a control circuit and a drive circuit for controlling the conduction of the switching element based on the received signal, a rectifying circuit for rectifying the AC output of the coil, a power source circuit unit for generating an operation power source for the control circuit and the like by smoothing out the rectified output, and the like will also be needed. Accordingly, the rotation load on the secondary side increases also in the case of using an electronic switch on the secondary side.

SUMMARY OF THE INVENTION

In view of this, the present invention enables selection of the heat generation amount of the heat generation member according to the size of a recording material without using a switch on the secondary side in a non-contact power supply method.

The present invention provides a heating apparatus comprising the following elements. A plurality of heat generation elements is provided on a heat generation film. A non-contact power supply unit is configured to supply power in a contactless manner to the plurality of heat generation elements. A variable impedance circuit is electrically connected to at least one of the plurality of heat generation elements, and in which an impedance changes according to the frequency of an alternating voltage supplied by the non-contact power supply unit. A frequency change unit is configured to switch heat generation amounts of the plurality of heat generation elements by changing the frequency according to the size of a recording material that is a heating target.

Further features of the present invention will become apparent from the following description of exemplary embodiments with reference to the attached drawings.

DESCRIPTION OF THE EMBODIMENTS

Embodiments of the present invention will be described in detail below with reference to the drawings. Note that members, numerical values, materials, and the like used in the description are merely examples for the purpose of aiding understanding and are not intended to limit the present invention.

Basic Concepts

A non-contact power supply unit that supplies power in a contactless manner from a power supply unit to multiple heat generation elements provided on a heat generation film is provided in the present invention. Furthermore, a variable impedance circuit is provided that is electronically connected to at least one of the heat generation elements, and the impedance of the variable impedance circuit changes according to the frequency of an alternating voltage supplied by the non-contact power supply unit. Moreover, a frequency change unit is provided that switches the heat generation amounts of the heat generation elements by changing the frequency according to the size of the recording material that is the heating target. In this way, due to the frequency change unit changing the frequency of an alternating voltage supplied in a contactless manner to the multiple heat generation elements according to the size of the recording material, the heat generation amounts of the multiple heat generation elements can be switched. The variable impedance circuit in which the impedance changes can be realized by a capacitance element and/or an inductor. By employing this kind of circuit, the heat generation amount can be selected according to the size of the recording material without providing a mechanical switch or an electronic switch on the secondary side.

Description of Basic Configuration of Image Forming Apparatus

Figure 1:
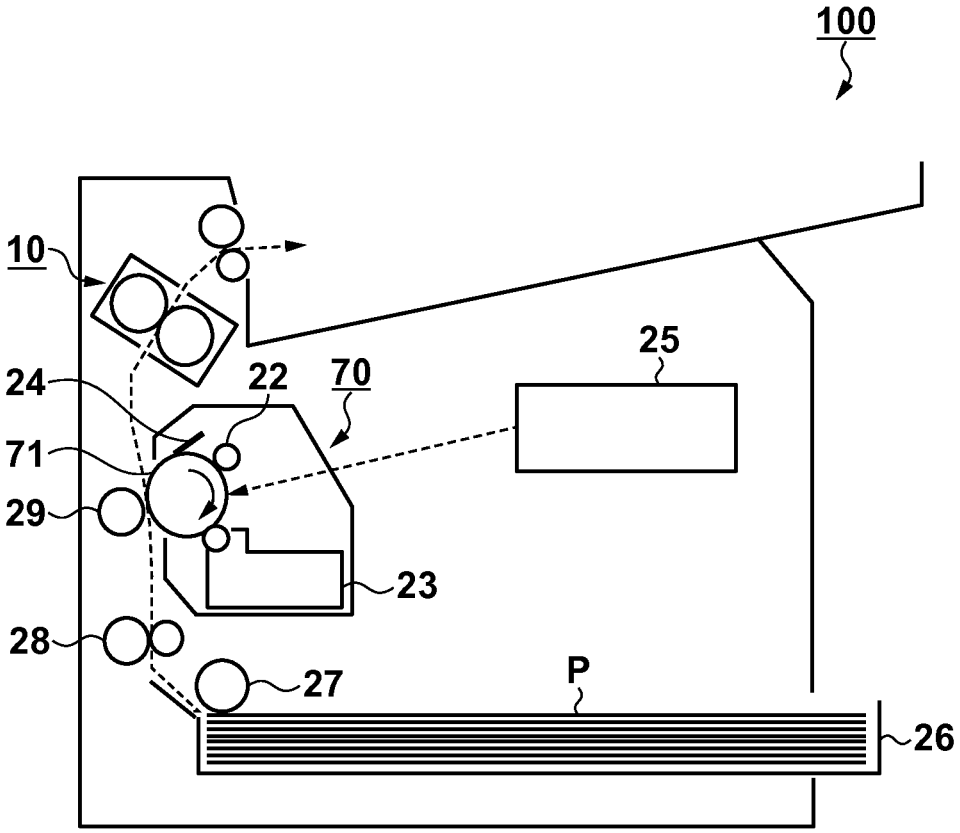
FIG. 1 is a diagram for illustrating a basic configuration of an image forming apparatus.

As shown in FIG. 1, an image forming apparatus 100 is a monochrome image forming apparatus including one image forming unit 70. While rotating a photoreceptor drum 71 that functions as an image carrying member, the image forming unit 70 executes charging, exposure, and development processes, and thereby forms a toner image on the surface of the photoreceptor drum 71. In the charging process, a charging roller 22 uniformly charges the surface of the photoreceptor drum 71. Next, a laser scanner 25 outputs a laser beam that is ON-OFF modulated in accordance with image data. The laser beam is deflected by a rotating mirror and scans the surface of the photoreceptor drum 71. According to this, an electrostatic latent image that corresponds to the image data is formed. A developer 23 develops the electrostatic latent image into a toner image using toner that is charged to a polarity that is opposite of that of the electrostatic latent image. A cleaning blade 24 rubs against the photoreceptor drum 71 and removes any transfer remnant toner remaining on the surface of the photoreceptor drum 71. A paper supply roller 27 withdraws one page of recording material P at a time from a paper supply cassette 26. A registration roller 28 conveys the recording material P so as to match the timing with the toner image formation in the image forming unit 70. The recording material P is sent to a transfer unit formed by the photoreceptor drum 71 and a transfer roller 29, and the toner image on the photoreceptor drum 71 is transferred to the recording material P. A fixing apparatus 10 applies heat and pressure to the recording material P onto which the toner image has been transferred. According to this, the image is fixed to the surface of the recording material P.

Note that the image forming apparatus 100 has been described as a monochrome image forming apparatus in order to simplify the description, but the present invention is not limited to this and can be applied to a color image forming apparatus as well. This is because a feature of the present invention lies in the configuration of the heating apparatus that applies heat to the fixing apparatus 10.

Description of Fixing Apparatus

Figure 2A:
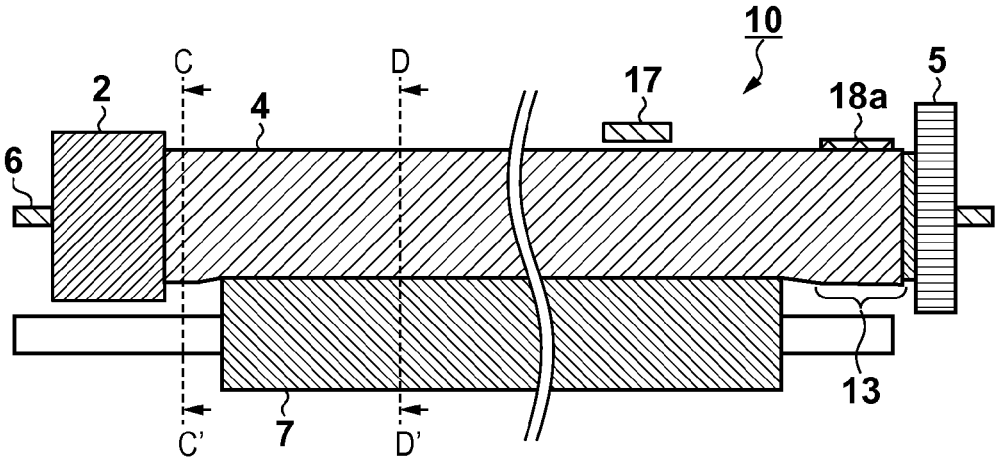
FIGS. 2A to 2D are diagrams for illustrating a basic configuration of a fixing apparatus.
Figure 2B:
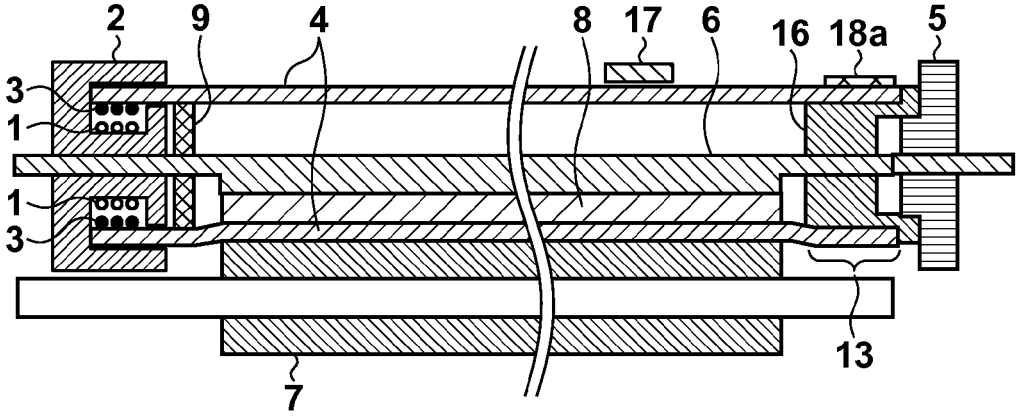
Figure 2C:
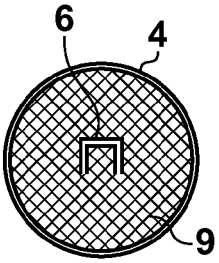
Figure 2D:
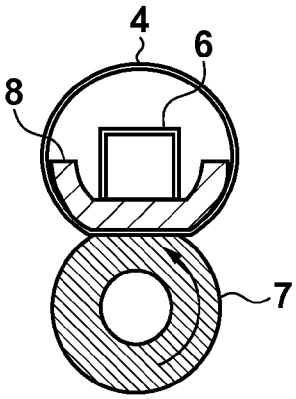

The configuration of the fixing apparatus 10 will be described with reference to FIGS. 2A, 2B, 2C, and 2D. FIG. 2A is a diagram of the rough configuration of the fixing apparatus 10 as viewed from the opening where the recording material is inserted (upstream side in the conveyance direction). FIG. 2B is a cross-sectional diagram in the lengthwise direction of the fixing apparatus 10. FIG. 2C is a cross-sectional diagram of the fixing apparatus 10 taken along line C-C' shown in FIG. 2A. FIG. 2D is a cross-sectional diagram of the fixing apparatus 10 taken along line D-D' shown in FIG. 2A. A cylinder-shaped heat-generation film 4, which is a rotating heat generation member, and a pressure roller 7 form a fixing nip in the fixing apparatus 10. The heat generation film 4 is sometimes referred to as fixing film or heating film as well. The recording material P carrying the toner image is subjected to pressure and heat when passing through the fixing nip, and thus the toner image is fixed on the recording material P.

A secondary coil 3 that functions as a power receiving coil is provided on one end of the heat generation film 4. The secondary coil 3 receives a supply of power in a contactless manner from a primary coil 1 that functions as a power transmission coil. In this way, the primary coil 1 and the secondary coil 3 function as a non-contact power supply unit that supplies power in a contactless manner to the heat generation elements.

A core member 2 is a ferrite core for forming a magnetic flux loop that is interlinked with the primary coil 1 and the secondary coil 3. Note that the configuration of the heat generation film 4 that includes the secondary coil 3, and the configuration and operations of the power transmission unit that includes the primary coil 1, the secondary coil 3, and the core member 2 will be described in detail later.

A film guide 8 shown in FIG. 2B is formed using a heat-resistant resin such as a liquid crystal polymer, PPS (polyphenylene sulfide), or PEEK (polyether ether ketone) and engages with a fixing stay 6. Both ends in the lengthwise direction of the fixing stay 6 are held to the image forming apparatus frame. Moreover, both ends in the lengthwise direction of the fixing stay 6 are pressed down in a downward direction by a pressure spring (not shown). Accordingly, the film guide 8 is pressed against the pressure roller 7. The pressure roller 7 is constituted by a cored bar made of iron, aluminum, or the like, an elastic layer made of silicone rubber or the like, and a release layer made of PFA (polytetrafluoroethylene) or the like.

With this kind of configuration, a fixing nip having a predetermined width in the conveyance direction of the recording material P is formed evenly in the lengthwise direction of the pressure roller 7. A temperature detection element 17 is arranged so as to detect a surface temperature near the center of the heat generation film 4 in a contactless manner. The detected temperature that was detected by the temperature detection element 17 is compared with a target value and is used to control the temperature of the heat generation film 4. Note that the temperature detection element 17 may be arranged on the film guide 8 such that it comes into contact with the inner circumferential face of the heat generation film 4. One end of the heat generation film 4 is held by a passive element holding member 16. The passive element holding member 16 is held by a fixing flange 5. The other end region of the heat generation film 4 is held by a film holding member 9.

The heat generation film 4 passively rotates in accordance with the rotation of the pressure roller 7 while sliding against the film holding member 9. At this time, the passive element holding member 16 also rotates while sliding against the heat generation film 4 and the fixing flange 5.

The passive element holding member 16 keeps a capacitance element 18*a* that is provided outside of the heat generation film 4, and the current route of the heat generation film 4 in an electrically stabilized state. A lightweight insulating material that can rotate in tandem with the heat generation film 4 while maintaining rigidity can be employed as the passive element holding member 16. The heat generation film 4 forms a film-shaped cylinder. The passive element holding member 16 is inserted on the inner wall (inner circumferential portion) of the cylinder. The region on the heat generation film 4 at which the passive element holding member 16 has been inserted will be referred to as a passive element holding region 13. An insulation layer and a conduction layer extend into the inner portion of the passive element holding region 13 as well.

The capacitance element 18*a* forms the main portion of the variable impedance circuit in which the impedance changes according to the frequency of the alternating voltage supplied by the non-contact power supply unit. A polypropylene film capacitor for high frequencies and large currents can be used as the capacitance element 18*a* for example. Another type of capacitance element can be employed as the capacitance element 18*a* as long as it can be attached to the outer portion or the inner portion of the heat generation film 4.

The pressure roller 7 is driven so as to rotate by a driving motor (not shown). The fixing flange 5 and the film holding member 9 engage with the fixing stay 6. The heat generation film 4 is flexible. Accordingly, in the region where the film guide 8 is present, the film guide 8 rotates in a path that follows the shape of the film guide 8 as shown in FIG. 2D.

The film holding member 9 has a circular cross-section as shown in FIG. 2C. The passive element holding member 16 also has a circular cross-section. For this reason, the rotational path of the heat generation film 4 is circular in the region to the left of the film holding member 9 and the region connected to the passive element holding member 16. The secondary coil 3 that is provided on the left end of the heat generation film 4 rotates in a state in which a circular shape is maintained. This difference in the rotational path of the heat generation film 4 that is dependent on the position in the lengthwise direction as seen in FIGS. 2C and 2D is absorbed by the flexibility of the heat generation film 4.

Description of Power Transmission Unit

Figure 3:
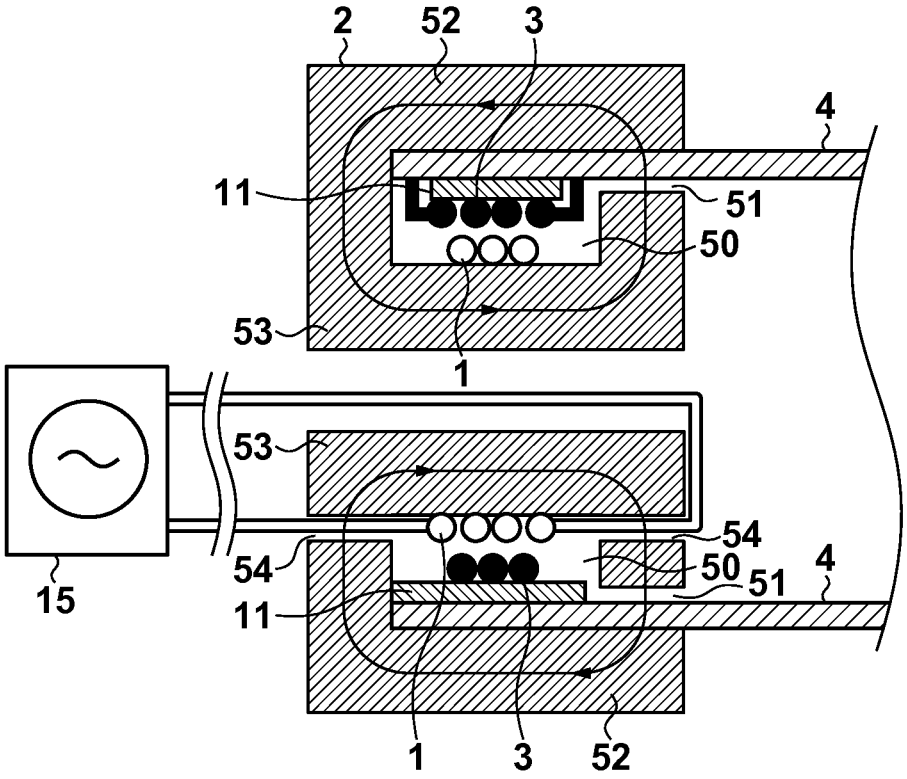
FIG. 3 is a schematic diagram showing a configuration of a power transmission unit.

FIG. 3 is a schematic diagram showing the configuration of the power transmission unit. The power transmission unit includes the primary coil 1 that is connected to an AC power source circuit 15, the secondary coil 3 that is included on the heat generation film 4, and the core member 2 that forms a magnetic flux loop that is interlinked with the primary coil 1 and the secondary coil 3. The AC power source circuit 15 functions as a power source unit that generates an alternating voltage having a predetermined frequency. The primary coil 1 and the secondary coil 3 are inductively coupled (magnetically coupled).

A litz wire to which an alternating current of about 10 A can be applied at a low loss can be used as the wire material for the primary coil 1 and the secondary coil 3 for example. The number of turns in the primary coil 1 and the secondary coil 3 is determined with consideration given to the configuration of the magnetic circuit, coil diameter, AC frequency, and the like, and is approximately several to 10 turns, for example.

As shown in FIG. 3, the primary coil 1 and the secondary coil 3 are arranged such that their respective positions overlap each other in the direction of the central shaft of the primary coil 1 (the horizontal direction in FIG. 3). The primary coil 1 is wound around an inner circumferential cylindrical portion 53 of the core member 2. The primary coil 1 is connected to the AC power source circuit 15 via two holes 54.

The secondary coil 3 is attached to the inner circumferential face of the heat generation film 4 via a secondary coil holding member 11. A lightweight heat-resistant resin or the like is used for the secondary coil holding member 11. The core member 2 has a cylinder-shaped interior space 50. The interior space 50 is connected to the external space via a ring-shaped gap portion 51. The left end of the heat generation film 4 is inserted into the interior space 50 via the gap portion 51 such that the secondary coil 3 is positioned in the interior space 50.

The core member 2 has an outer circumferential cylindrical portion 52 and an inner circumferential cylindrical portion 53. The heat generation film 4 slides against the inner side of the outer circumferential cylindrical portion 52. Note that the heat generation film 4 may be held by the core member 2 rather than by the film holding member 9.

Description of Heat Generation Unit

Figure 4A:
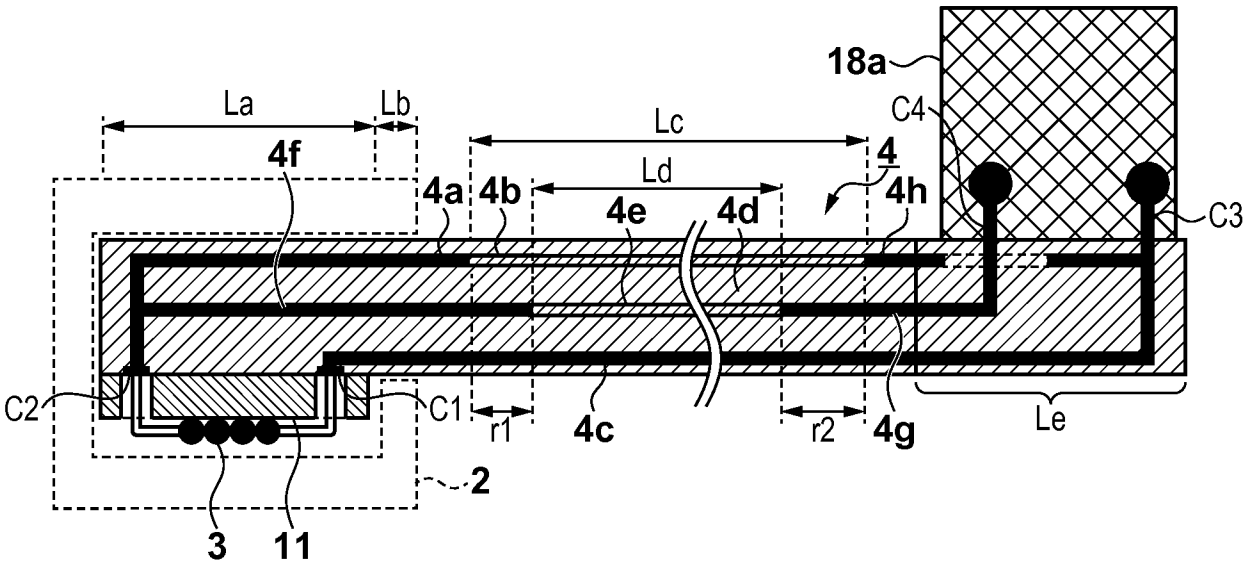
FIGS. 4A and 4B are schematic diagrams for illustrating a layer configuration of a heat generation film.
Figure 4B:
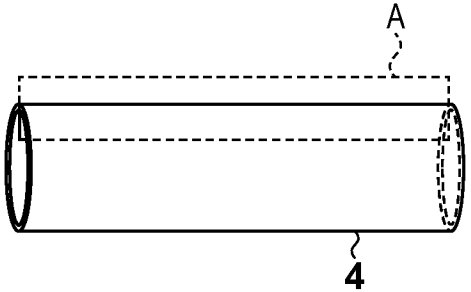

The configuration of the heat generation units corresponding to recording material sizes will be described next. FIG. 4A is a cross-sectional diagram showing a portion of the heat generation film 4 in FIG. 2B. FIG. 4B is a diagram for describing the cross-section shown in FIG. 4A. More specifically, FIG. 4A shows the cross-section of region A of the heat generation film 4. In FIG. 4A, La indicates a region inserted in the interior space 50 of the core member 2 and Lb indicates a region inserted in the gap portion 51. Lc indicates a region for fixing the toner image on the recording material having a first size and Ld indicates a region for fixing the toner image on the recording material having a second size. Note that the difference between the widths of the region Lc and the region Ld is r1+r2. Le indicates a region of the heat generation film 4 that corresponds to the passive element holding region 13 shown in FIG. 2A.

Here, for the sake of convenience in the description, a first size (e.g., B4 size) and a second size that is smaller than the first size (e.g., A4 size) are used as the recording material sizes. Of course, the present invention can be applied to three or more types of sizes as well. For example, in order to handle three types of sizes, it is sufficient that three types of heat generation elements corresponding to the sizes are employed.

The structure of the cross-section of the heat generation film 4 is a structure including an insulation layer 4*d*, a heat generation layer 4*b* for the B4-size recording material, an insulation layer 4*d*, a heat generation layer 4*e* for the A4-size recording material, an insulation layer 4*d*, a conduction layer 4*c*, and an insulation layer 4*d*, which are stacked in the stated order from the fixing surface inward. The insulation layer 4*d* between the heat generation layer 4*b* and the heat generation layer 4*e* is constituted by a material that electrically blocks the heat generation layers 4*b* and 4*e* but is sufficiently capable of conducting heat. The insulation layer 4*d* is approximately several tens of μm thick, for example.

The conduction layer 4*a* and the conduction layer 4*h* for conducting electricity to the heat generation layer 4*b* are provided in non-heat-generation regions located on both sides of the heat generation layer 4*b* in the rotating shaft direction (lengthwise direction) of the heat generation film 4. Similarly, the conduction layer 4*f* and the conduction layer 4*g* are provided in non-heat-generation regions on both sides of the heat generation layer 4*e*.

The heat generation layer 4*b* is a first heat generation element that corresponds to the recording material having the first size. The heat generation layer 4*e* is a second heat generation element that corresponds to the recording material having the second size. The heat generation layers 4*b* and 4*e* are formed using a polyimide with a thickness of around 50 to 70 μm whose resistance value has been adjusted by dispersing carbon black as a conductive filler for example. The actual resistance value between the ends in the lengthwise direction of the heat generation layers 4*b* and 4*e* is from approximately several ohms to around a dozen ohms, for example. The insulation layer 4*d* is formed using a polyimide. The conduction layers 4*a*, 4*c*, 4*f*, 4*g*, and 4*h* are formed using a metallic material such as copper or aluminum. An elastic layer and a release layer may be furthermore provided on the outer surface of the heat generation film 4, although this is not shown in FIG. 4A. Silicone rubber or the like having a thickness of 200 μm for example can be employed as the elastic layer. PFA or the like having a thickness of 15 μm to 20 μm for example can be used as the release layer.

According to FIG. 4A, the conduction layer 4*c* is connected to the heat generation layers 4*b* and 4*e* via the conduction layers 4*h* and 4*g* on the opposite side (right side of FIG. 4A) of the side on which the secondary coil 3 is provided (left side of FIG. 4A). The conduction layer 4*c* is arranged in a state of being formed up to the core inner region La and being exposed to the inner surface of the heat generation film 4. A contact point C1 for connecting to the secondary coil 3 is formed on the end of the conduction layer 4*c*. Similarly, a contact point C2 for connecting to the secondary coil 3 is formed on the ends of the conduction layer 4*a* and the conduction layer 4*h*. A contact point C3 for connecting to the capacitance element 18*a* is formed on the end of the conduction layer 4*h*. The contact point C3 is connected to the conduction layer 4*c* as well. A contact point C4 for connecting to the capacitance element 18*a* is formed on the end of the conduction layer 4*g*. The capacitance element 18*a* functions as a capacitance element in which the impedance changes according to the frequency.

The number and the length in the lengthwise direction of the heat generation layers 4*b* and 4*e* are determined according to the sizes of recording material that can be used by the image forming apparatus 100 according to its design. Accordingly, the present invention is not limited to the above-described case. The connection relationship in the lengthwise direction of the heat generation film 4 is as follows.

The contact point C2 of the secondary coil 3, the conduction layer 4*a*, the heat generation layer 4*b*, the conduction layer 4*h*, and the conduction layer 4*c* are connected in the stated order, and therefore the heat generation layer 4*b* that corresponds to the width of the B4 recording material is connected to the other contact point C1 of the coil 3. The contact point C2 of the secondary coil 3, the conduction layer 4*f*, the heat generation layer 4*e*, the conduction layer 4*g*, the contact point C4, the capacitance element 18*a*, the contact point C3, and the conduction layer 4*c* are connected in the stated order, and therefore the heat generation layer 4*e* corresponding to the width of the A4 recording material is connected to the other contact point C1 of the coil 3.

Figure 5A:
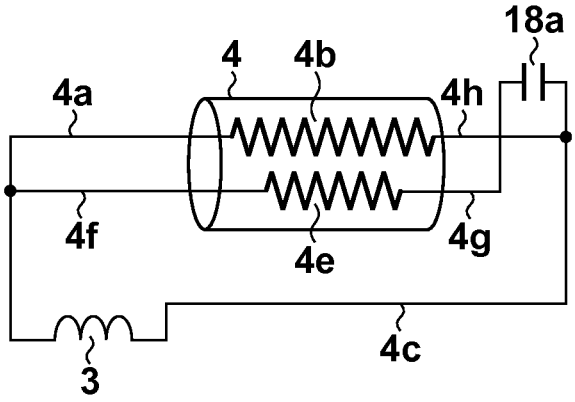
FIGS. 5A and 5B are circuit diagrams of a secondary coil side.
Figure 5B:
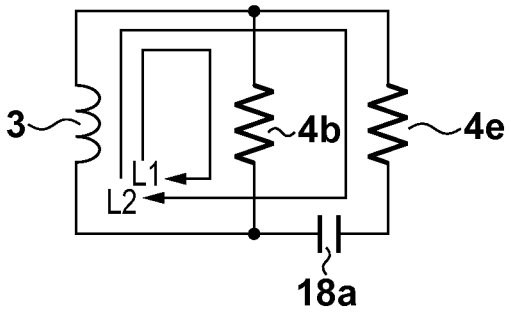

FIG. 5A shows an equivalence circuit in which the conduction layers and the like shown in FIG. 4 have been directly replaced with electrical elements. FIG. 5B shows an equivalence circuit that has been rearranged for the description. The heat generation film 4 has two circuits (closed circuits). The first circuit is a loop L1 that is configured by the secondary coil 3, the conduction layer 4*a*, the heat generation layer 4*b*, the conduction layer 4*h*, and the conduction layer 4*c*. The second circuit is a loop L2 that is constituted by the secondary coil 3, the conduction layer 4*f*, the heat generation layer 4*e*, the conduction layer 4*g*, the capacitance element 18*a*, and the conduction layer 4*c*.

Figure 6A:
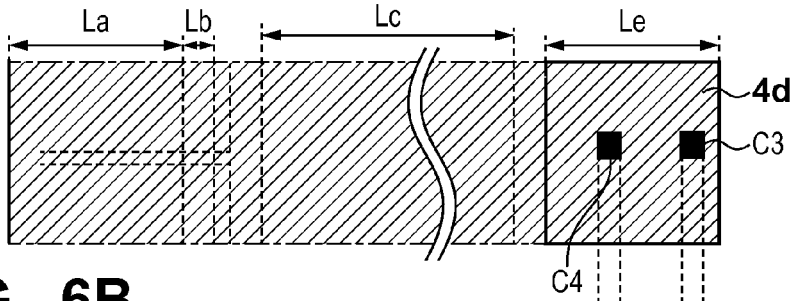
FIGS. 6A to 6E are schematic diagrams for illustrating shapes of heat generation film layers.
Figure 6B:
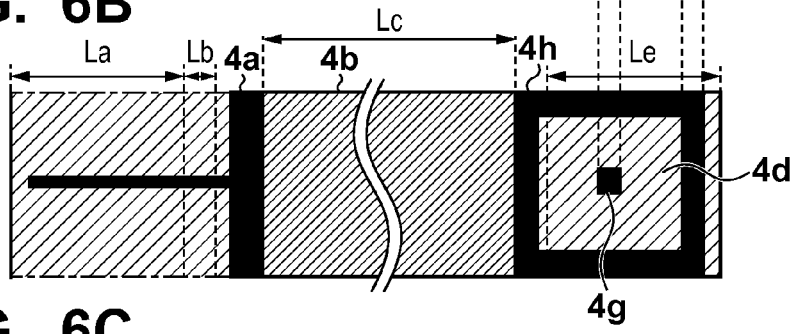
Figure 6C:
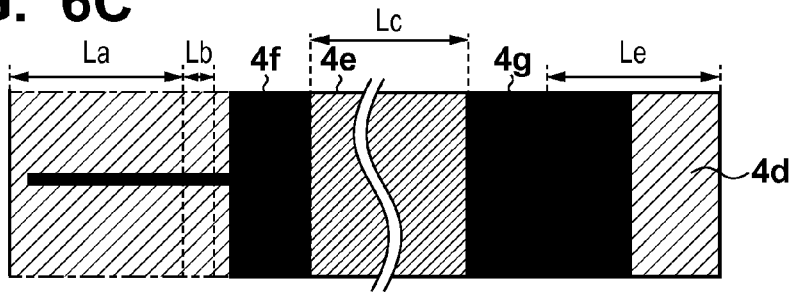
Figure 6D:
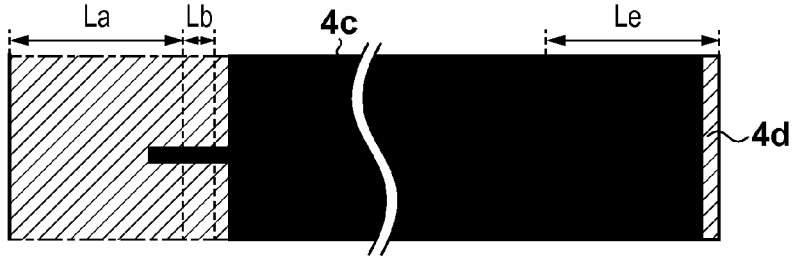
Figure 6E:
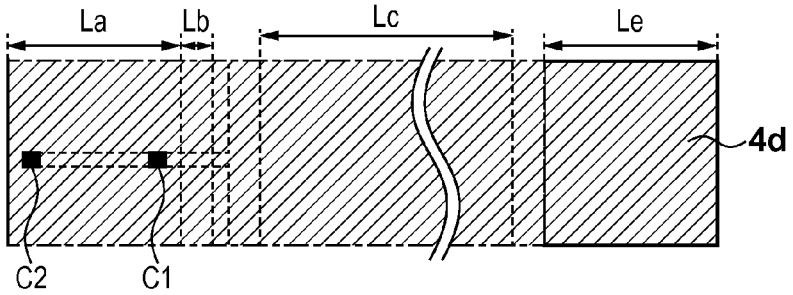

FIGS. 6A to 6E are schematic diagrams (expanded views) showing expanded views of the heat generation film 4 in order to describe the shapes of the layers. The heat generation film 4 has a cylindrical shape, and therefore when it is expanded, it has a rectangular shape. FIG. 6A shows the surface layer of the heat generation film 4. FIG. 6B shows the layer including the heat generation layer 4*b*. FIG. 6C shows the layer including the heat generation layer 4*e*. FIG. 6D shows the layer including the conduction layer 4*c*. FIG. 6E shows the rear surface layer.

The contact points C3 and C4 that are connected to the capacitance element 18*a* are provided on the front surface (outer circumferential face) of the fixing film 4 as shown in FIG. 6A. The two terminals of the capacitance element 18*a* are aligned with the contact points C3 and C4 and are fixed to the outer circumferential surface of the fixing film 4.

As shown in FIG. 6B, the heat generation layer 4*b* and the conduction layer 4*h* are formed over the entire circumference in the circumferential direction, but the conduction layer 4*a* is formed on only a portion in the circumferential direction in a core inner region La, a core gap portion passing region Lb, and the vicinity thereof. The conduction layer 4*a* is formed in this kind of shape for two main reasons. The first reason is to minimize the decrease in power transmission efficiency that occurs when magnetic flux passing through the gap portion 51 is obstructed by the conduction layer 4*a*. The second reason is to prevent current from flowing in the conduction layers formed over the entire circumference in the circumferential direction in the core inner region La. As shown in FIG. 6B, the center of the conduction layer 4*h* is hollowed out in the region Le, and portions of the insulation layer 4*d* and the conduction layer 4*g* are provided therein. The conduction layer 4*g* is electrically connected to the contact point C4. The conduction layer 4*h* is connected to the contact point C3.

As shown in FIG. 6C, the heat generation layer 4*e* and the conduction layers 4*f* and 4*g* are formed over the entire circumference in the circumferential direction. However, the conduction layer 4*f* is formed on only a portion in the circumferential direction in the core inner region La, the core gap portion passing region Lb, and the vicinity thereof for reasons similar to those of the conduction layer 4*a* in FIG. 6B.

As shown in FIG. 6D, the conduction layer 4*c* is formed over the entire circumference in the circumferential direction of the heat generation film 4 in the fixing region Lc and the vicinity thereof. Also, the conduction layer 4*c* is formed on only a portion in the circumferential direction in the core gap portion passing region Lb and the vicinity thereof for reasons similar to those in FIG. 6B. In the region Le, the conduction layer 4*c* is electrically connected to the conduction layer 4*h* that is formed above.

As shown in FIG. 6E, the contact point C2 for connecting the conduction layer 4*f* in FIG. 4C to one end of a coil, and the contact point C1 for connecting the conduction layer 4*c* in FIG. 4D to the other end of a coil are provided on the rear face of the heat generation film 4.

Note that the insulation layer 4*d* is provided between the conduction layer 4*a* in FIG. 6B and the conduction layer 4*f* in FIG. 6C. Similarly, the insulation layer 4*d* is basically provided between the conduction layer 4*h* in FIG. 6B and the conduction layer 4*c* in FIG. 6E as well. Note that as shown in FIG. 4A, the conduction layer 4*c* is electrically connected to the conduction layer 4*h* that is formed above in the region Le.

Description of Power Supply Circuit

Figure 7:
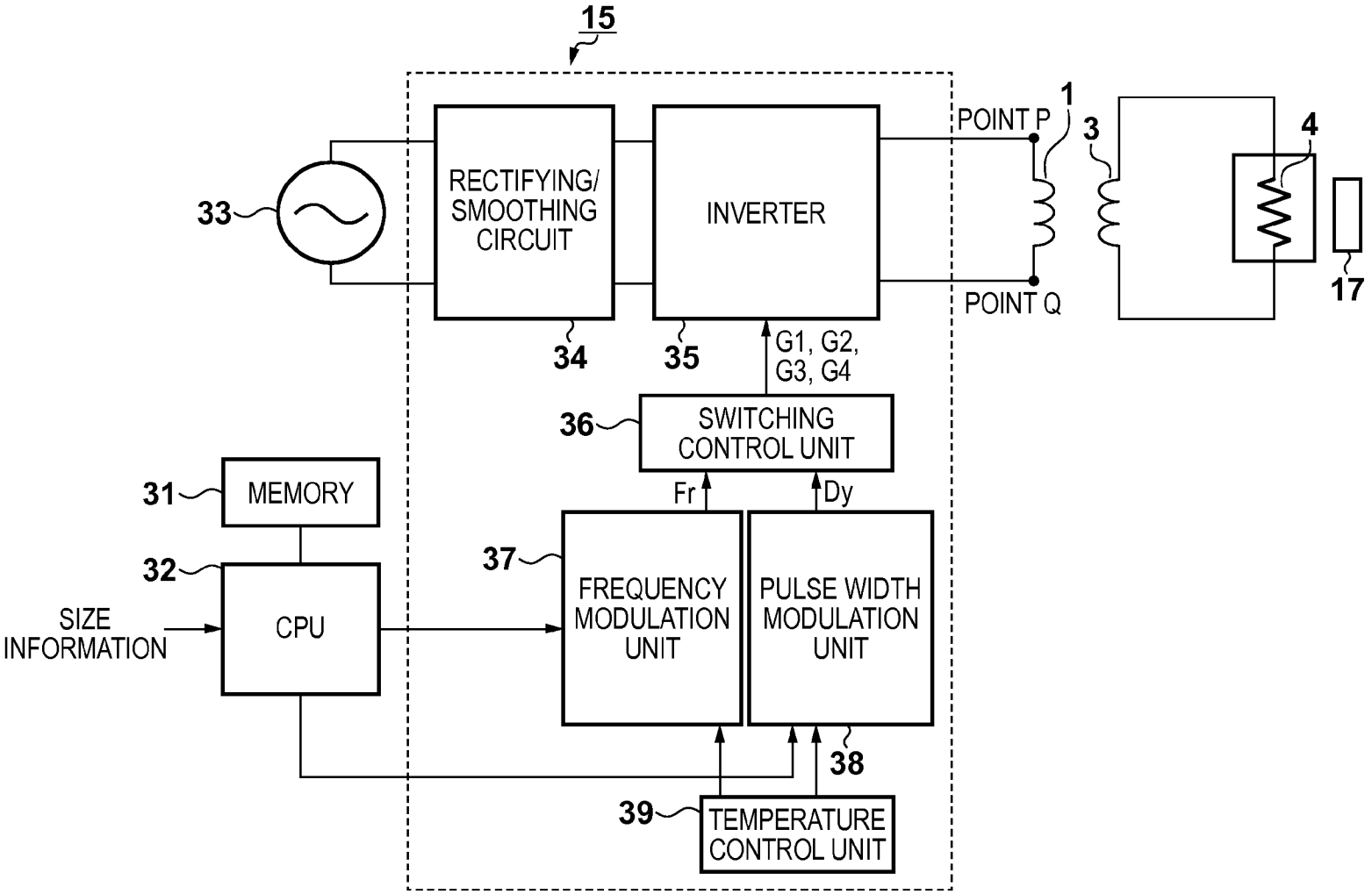
FIG. 7 is a circuit diagram of a power transmission system.
Figure 8:
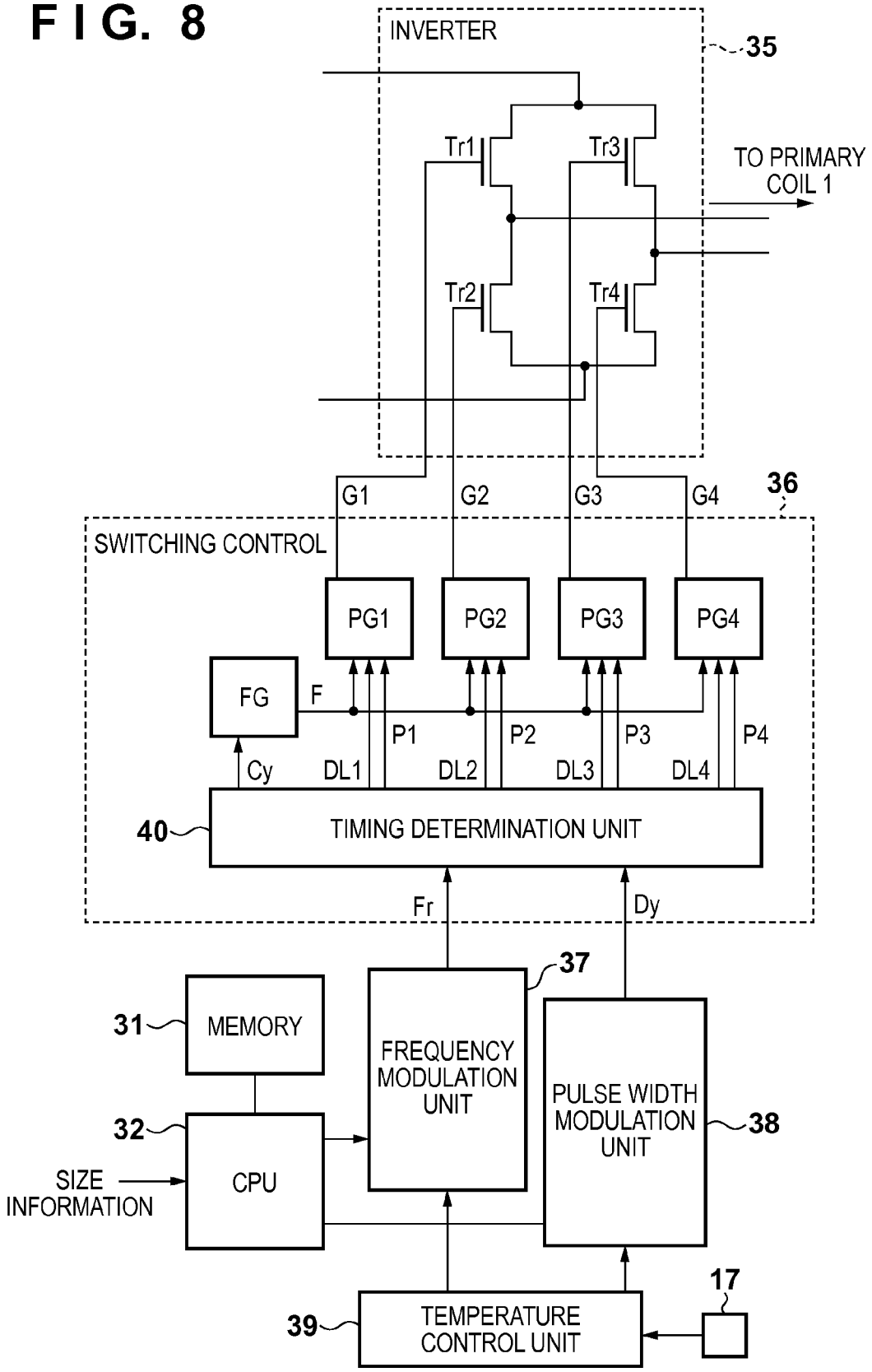
FIG. 8 is a circuit diagram of an AC power source.

FIG. 7 shows an outline of the circuit configuration of the power transmission system from a commercial power source 33 to the heat generation film 4. The AC power source circuit 15 is constituted by a rectifying/smoothing circuit 34, an inverter 35, a switching control unit 36, a frequency modulation unit 37, a pulse width modulation unit 38, and a temperature control unit 39. The rectifying/smoothing circuit 34 is a circuit that generates a direct current by rectifying and smoothing an alternating current. The inverter 35 is a circuit that converts the direct current into an alternating current that satisfies a configured condition. The inverter 35 includes four FETs (field effect transistors Tr1, Tr2, Tr3, and Tr4) as shown in FIG. 8. The frequency modulation unit 37 is a circuit that generates a signal Fr for notifying the switching control unit 36 of the frequency designated by the CPU 32. The pulse width modulation unit 38 generates a signal for notifying the switching control unit 36 of a pulse width Dy obtained by correcting the pulse width designated by the CPU 32 in accordance with an instruction from the temperature control unit 39. The switching control unit 36 controls the inverter 35 so as to generate an alternating voltage that has a frequency corresponding to the recording material size in the width direction and a duty for setting the heat generation amount of the fixing film 4 to the target heat generation amount.

Size information indicating the recording material size instructed by the user is sent from an external PC to the CPU 32 of the image forming apparatus 100. The CPU 32 determines the frequency that corresponds to the recording material size by referencing a table stored in a memory 31. The CPU 32 designates the initial value of the pulse width. The AC power source circuit 15 controls the inverter 35 based on the frequency and pulse width designated by the CPU 32 and applies an AC current that satisfies the configured conditions to the primary coil 1.

Figure 9A:
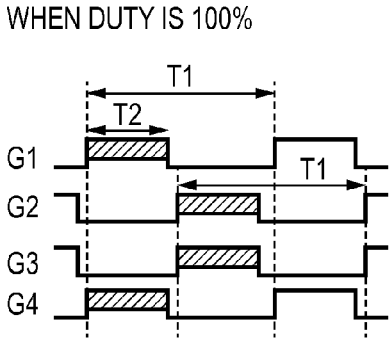
FIGS. 9A and 9B are diagrams of input signals to be input to an inverter.

Operations by the AC power source circuit 15 will be described in detail next. The rectifying/smoothing circuit 34 converts the alternating current supplied from the commercial power source 33 into direct current and inputs it to the inverter 35. As shown in FIG. 8, the four transistors Tr1 to Tr4 are provided in the inverter 35. The switching control unit 36 inputs pulse signals G1, G2, G3, and G4 to the gates of Tr1, Tr2, Tr3, and Tr4 respectively. The pulse signals G1, G2, G3, and G4 may also be referred to as gate signals or drive signals. FIG. 9A shows the pulse signals G1, G2, G3, and G4 when the duty of the pulse-shaped alternating voltage to be supplied to the primary coil 1 is at 100%. The frequency f of the pulse signals G1, G2, G3, and G4 is 1/T1. T1 is the repetition period of the pulse signals in FIG. 9A. The frequency f is determined using a value configured in advance according to the recording material size, based on the relationship thereof with the design constant of the heat generation unit shown in FIG. 3. The setting value is stored in the memory 31.

The temperature control unit 39 determines the duty of the pulse that is to be applied to the primary coil 1 according to the difference between the surface temperature measured by the temperature detection element 17 and the target temperature of the heat generation film 4. As shown in FIG. 9A, the duty of the pulse in the case where the period in which Tr1 is ON according to the pulse signal G1 and the ON period of Tr4 are the same is 100%.

Figure 9B:
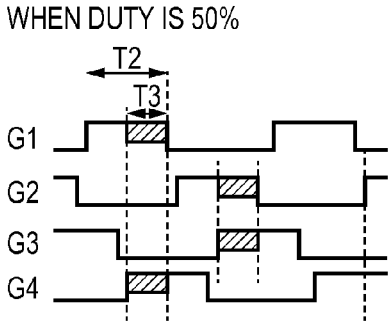

The period in which the current flows from point P to point Q in the primary coil 1 shown in FIG. 7 is the amount of time that Tr1 is ON and Tr4 is ON. By shifting the ON period of Tr4 relative to the ON period of Tr1, the temperature control unit 39 adjusts the period in which the current flows from point P to point Q in the primary coil 1. As shown in FIG. 9B, if T3/T2 is set to 0.5, the duty is 50%.

The amount of time for which the current flows from point Q to point P in the primary coil 1 is determined as the amount of time for which Tr2 is ON and Tr3 is ON. That is to say, an alternating current having a predetermined frequency that corresponds to a drain current that flows when both Tr1 and Tr4 are ON and a drain current that flows when both Tr3 and Tr2 are ON, flows to the primary coil 1 for a predetermined amount of time.

When the alternating current (AC) flows to the primary coil 1 that is connected to the AC power source circuit 15, a current having the same frequency flows to the secondary coil 3 due to electromagnetic inductance. By doing so, power is transmitted in a contactless manner from the primary coil 1 to the secondary coil 3 and the heat generation film 4 generates heat. The surface temperature of the heat generation film 4 is measured by the temperature detection element 17 and is fed back to the temperature control unit 39. The temperature control unit 39 controls the pulse width modulation unit 38 to adjust the duty of the output pulse of the inverter 35 such that the detected temperature is the predetermined target value. According to this, the amount of time for which the AC current flows in the primary coil 1 is corrected, and thereby the detected temperature is maintained at the predetermined target value.

Description of Operations Inside Heat Generation Film

The values of the passive elements constituting the circuits in FIGS. 5A and 5B are set as follows for example.

$$R4b=10\Omega$$

$$R4e=8\Omega$$

Capacity $C18a$ of the capacitance element $18a$=0.1 μF

The length of the heat generation layer 4*e* in the rotating shaft direction of the fixing film 4 is shorter than the length of the heat generation layer 4*b*. For this reason, the resistance value R4*e* of the heat generation layer 4*e* is also smaller than the resistance value R4*b* of the heat generation layer 4*b*. The impedances of the loop L1 and the loop L2 are the composite resistance of the resistance components including a heat generation resistance layer, and the capacitance element 18*a*. In particular, the loop L2 is a high-pass filter circuit to which the capacitance element 18*a* is directly connected.

Here, recording materials having two sizes, namely a B4 size and an A4 size, can pass through the fixing apparatus 10. The frequency f of the current that flows from the AC power source circuit 15 to the primary coil 1 is determined based on the circuit constants of the passive elements shown in FIGS. 5A and 5B. Here, a first frequency f1 in the case of the B4-size recording material is 20 kHz, and a second frequency f2 in the case of the A4-size recording material is 200 kHz. This value is stored in advance in the memory 31 in the image forming apparatus 100.

A case of printing on a B4-size recording material whose recording material size in the width direction is relatively large will be described first. Through a PC or the like, the user gives the image forming apparatus 100 an instruction to print on the B4-size recording material. The CPU 32 configures the printing mode for the charging, exposure, and developing processes to the B4-size printing mode in accordance with the size information.

Figure 10A:
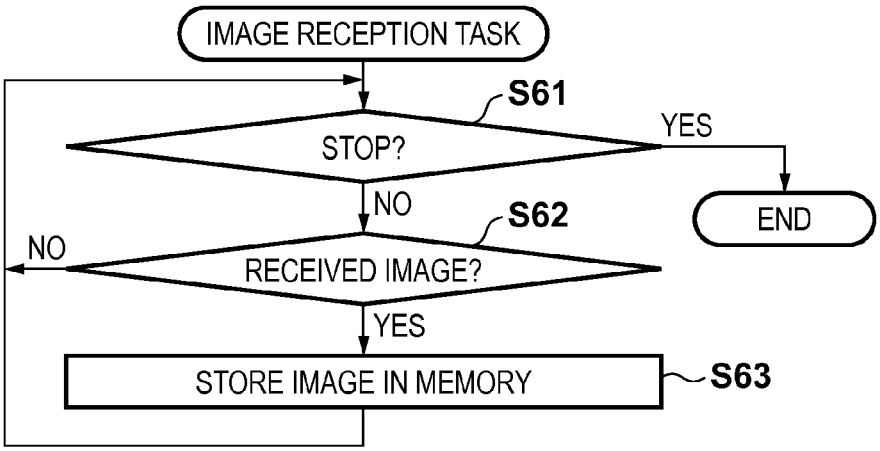
FIGS. 10A and 10B are flowcharts of CPU tasks.
Figure 10B:
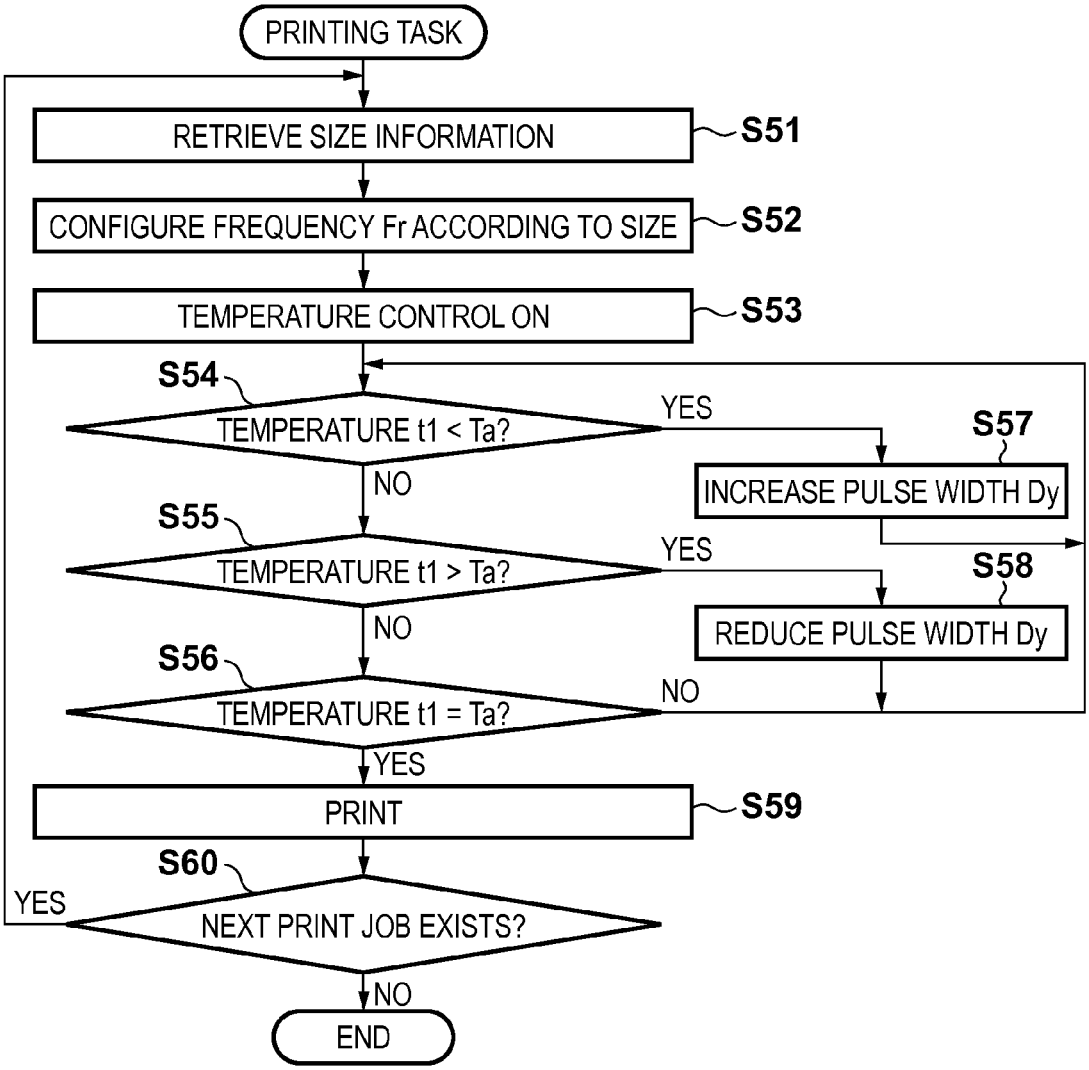

FIG. 10A and FIG. 10B show flowcharts of tasks executed by the CPU 32 in the image forming apparatus 100. FIG. 10A shows an image reception task performed by the CPU 32. FIG. 10B shows tasks after the image is received, up to when the temperature control of the heat generation film 4 is performed via the AC power source circuit 15 by the CPU 32 according to the recording material size information and printing is performed.

In FIG. 10A, after the power source of the image forming apparatus 100 is switched on, the CPU 32 is in a standby state up to when an image is received from the external PC or the like. In step S61, the CPU 32 determines whether or not to stop the image forming apparatus 100 according to whether or not the main power source switch has been switched off. If an instruction to stop is given, the CPU 32 executes shutdown processing and stops the image forming apparatus 100. If an instruction to stop has not been given, the procedure moves to step S62. In step S62, the CPU 32 determines whether or not an image has been received. If an image has not been received, the procedure returns to step S61, and if an image has been received, the procedure returns to step S63. In step S63, the CPU 32 stores the image in the memory 31 and starts the printing task.

The printing task will be described next with reference to FIG. 10B. In step S51, the CPU 32 retrieves the size information designated by the user from the memory 31. The size information includes the B4 size, the A4 size, and the like. In step S52, the CPU 32 references the table stored in the memory 31, reads out the frequency data that corresponds to the size information, and transmits the read-out frequency data to the frequency modulation unit 37.

Figures 11, 12:
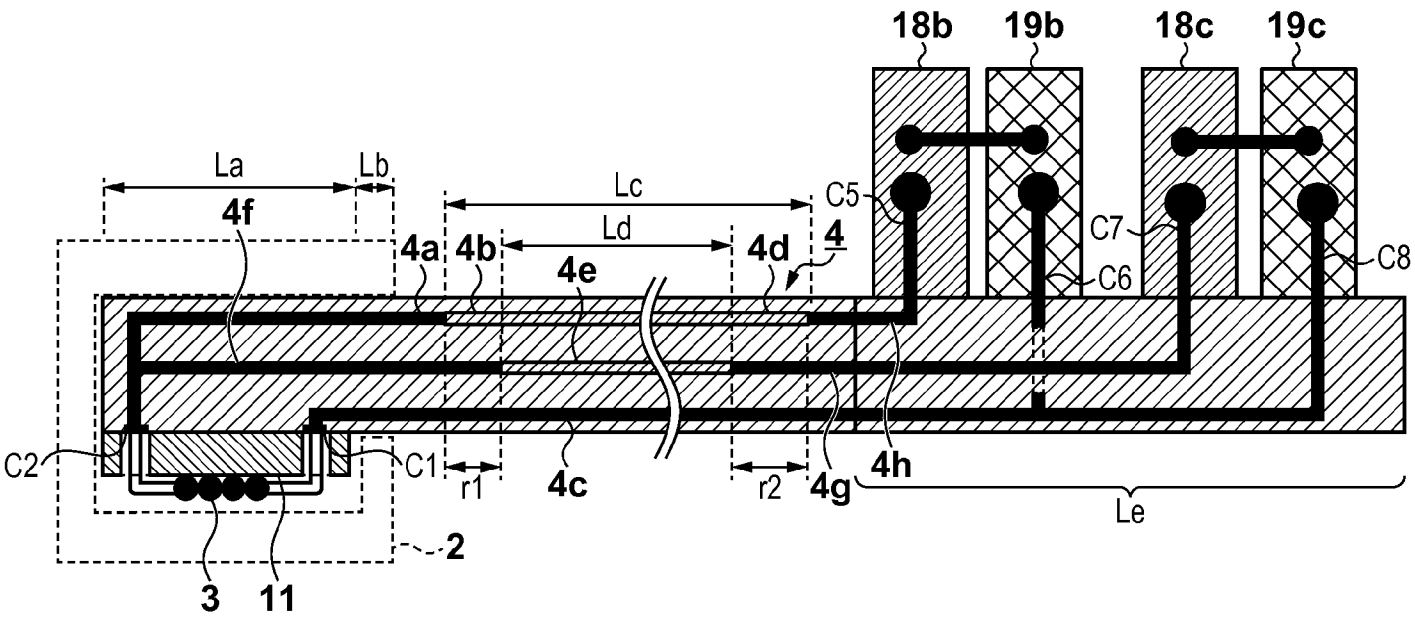
FIG. 11 is a diagram showing an example of a table.
FIG. 12 is a schematic diagram for illustrating a layer configuration of a heat generation film.

As shown in FIG. 11, the size information and the frequencies are in a one-to-one association in the table stored in the memory 31. Note that the association between the size information and the frequencies may be held using a data management method other than a table. According to FIG. 11, B4 size is associated with 20 kHz and A4 size is associated with 200 kHz.

In step S53, the CPU 32 causes the temperature control unit 39 to start temperature control. In steps S54 to S58, the CPU 32 changes the pulse width Dy using the pulse width modulation unit 38 until the surface temperature t1 of the heat generation film 4 reaches the target temperature Ta. That is to say, in step S54, the CPU 32 determines whether or not the surface temperature t1 is lower than the target temperature Ta. If the surface temperature t1 is lower than the target temperature Ta, the procedure moves to step S57. In step S57, the CPU 32 increases the pulse width Dy so as to raise the surface temperature t1. Subsequently, the procedure returns to step S54. If the surface temperature t1 is not lower than the target temperature Ta, the procedure moves to step S55. In step S55, the CPU 32 determines whether or not the surface temperature t1 is higher than the target temperature Ta. If the surface temperature t1 is higher than the target temperature Ta, the procedure moves to step S58. In step S58, the CPU 32 reduces the pulse width Dy so as to lower the surface temperature t1. Subsequently, the procedure returns to step S54. If the surface temperature t1 is not higher than the target temperature Ta, the procedure moves to step S56. In step S56, the CPU 32 determines whether or not the surface temperature t1 matches the target temperature Ta. If they do not match, the procedure returns to step S54, and if they do match, the procedure moves to step S59.

Note that steps S54 to S58 may all be executed by the temperature control unit 39. In that case, the temperature control unit 39 notifies the CPU 32 that the surface temperature t1 matches the target temperature Ta.

In step S59, the CPU 32 controls the image forming unit 70 and the like so as to start printing. In step S60, the CPU 32 determines whether or not there is another print job. If there is another print job, the procedure returns to step S51, and if there is no job, the printing task ends.

Operations performed by the CPU 32 have been described above, and the operations of circuits that are coordinated with that series of operations will be described next with reference to the circuit diagram in FIG. 8. When the size information is received, the CPU 32 stores it in the memory 31. The drive frequency of the primary coil 1 corresponding to the received size information is acquired from the table and configured in the frequency modulation unit 37 by the CPU 32. If the received size information indicates the B4 size, 20 kHz is configured in the frequency modulation unit 37. The frequency value that corresponds to the size information is sent from the frequency modulation unit 37 to the timing determination unit 40 and is furthermore sent to a trigger signal generation unit FG. The trigger signal generation unit FG transmits a common trigger signal to pulse signal generation units PG1, PG2, PG3, and PG4. The frequency of the trigger signal is a frequency that corresponds to the size information, and for example, it is 20 kHz.

The duty value that was determined according to the surface temperature of the heat generation film 4 is transmitted to the timing determination unit 40 by the pulse width modulation unit 38. The initial value of the duty is 100% for example. The temperature control unit 39 controls the pulse width modulation unit 38 such that the duty value increases or decreases according to the surface temperature t1. The timing determination unit 40 determines the pulse widths P1 to P4 at the ON time and delay times DL1 to DL4 from the trigger signal F based on the duty value received from the pulse width modulation unit 38 and transmits them to the pulse signal generation units PG1 to PG4. The pulse signal generation units PG1 to PG4 generate the pulse signals G1 to G4 that correspond to the 20-kHz trigger signal F, the delay times DL1 to DL4, and the pulse widths P1 to P4 that were input. The pulse signals G1 to G4 are gate voltages for the corresponding transistors Tr1 to Tr4. As a result, an alternating current of 20 kHz with a predetermined duty flows from the AC power source circuit 15 to the primary coil 1 in the fixing apparatus 10. When the power is transmitted to the secondary coil 3, current flows along the loop L1 in FIG. 5B to the heat generation layer 4*b* and heat is generated. On the other hand, the impedance ZL2 of the loop L2 that forms a high-pass filter circuit is calculated using the following equation.

$$ZL2=\sqrt{\{R4e^2+1/(2\pi f\cdot C18a)^2\}} \quad \text{Equation 1}$$

If f is 20 kHz, R4*e* is 8Ω, and C18*a* is 0.1 μF, ZL2 is about 80Ω.

The impedance ZL1 of the loop L1 is determined by the resistance value of the heat generation layer 4*b* (10Ω). Accordingly, if the frequency is 20 kHz, only ⅛ of the current of the loop L1 flows in the loop L2. Accordingly, the temperature of the heat generation layer 4*e* barely increases at all. As a result, the fixing of the B4-size recording material is executed using the heat generation of the heat generation layer 4*b*.

Next, a case will be considered in which printing is performed using the A4-size recording material whose recording material size in the width direction is relatively small. The user instructs the image forming apparatus 100 to print an image on the A4-size recording material. Similarly to the above-described case of the B4-size recording material, the frequency of 200 kHz that corresponds to the recording material size is called from the memory 31 by the CPU 32 in the AC power source circuit 15 of the image forming apparatus 100. The inverter 35 is driven using the 200-kHz pulse signals G1 to G4 that have the delay times DL1 to DL4 and the pulse widths P1 to P4 that were determined based on the instruction from the CPU 32 and the surface temperature t1 of the heat generation film 4 at that time. As a result, a current with a frequency of 200 kHz that is configured for the A4 recording material size flows in the primary coil 1 of the fixing apparatus 10.

The impedance ZL2 of the high-pass filter circuit in the loop L2 that is constituted by the resistance value R4*e* of the heat generation layer 4*e* and the capacity C18*a* of the capacitance element 18*a* is calculated by substituting 200 kHz into Equation 1. Based on Equation 1, ZL2 is approximately 11Ω. Accordingly, since the impedances of the loop L1 and the loop L2 are approximately the same, the current is divided and flows in both the loop L1 and the loop L2. As a result, both the heat generation layer 4*b* and the heat generation layer 4*e* generate heat. The heat in the heat generation layer 4*e* is propagated to the heat generation layer 4*b* via the insulation layer 4*d* that is sufficiently thin for heat to propagate therethrough. The surface temperature of the heat generation film 4 is controlled to the temperature needed for fixing using the heat of both the heat generation layer 4*e* and the heat generation layer 4*b* in the fixing region Ld for the A4 recording material. The temperature in the heat generation layer 4*b* on its own is configured to a temperature lower than that at the time of the B4 recording material fixing. For this reason, only the heat of the heat generation layer 4*b* reaches the outer portion of the fixing region Ld for the A4 recording material, and the temperature of the outer portion is not likely to exceed the heat resistant temperature of the fixing film 4.

In order to prevent excessive current from flowing in the heat generation layer 4*b*, the smaller the impedance ZL2 of the loop L2 relative to the impedance ZL1 of the loop L1 is, the better (in the case of 200 kHz). For this reason, in order to satisfy the following relationship, the resistance value of the heat generation layer 4*b* is set higher than the resistance value of the heat generation layer 4*e* by changing the amount of carbon included therein, for example.

(resistance value of the heat generation layer 4*b*)>
(resistance value of the heat generation layer 4*e*)

The temperature control unit 39 monitors the surface temperature of the heat generation film 4 using the temperature detection element 17 and adjusts the surface temperature to the target value, and therefore the duty of the current that flows in the primary coil 1 may be finely adjusted. For example, the temperature of the surface of the heat generation film 4 that is needed for fixing is 200° C., and the duty of the initial current pulse is assumed to be 50%. The surface temperature t1 is read using the temperature detection element 17.

If t1=200° C., the temperature control unit 39 keeps the duty at 50%.

If t1<200° C., the temperature control unit 39 increases the duty in order to increase the current value such that the temperature rises by (200° C.−t1).

If t1>200° C., the temperature control unit 39 reduces the duty in order to reduce the current value such that the temperature decreases by (t1−200° C.).

The method of changing the frequency is also an example of a method for keeping the surface temperature t1 of the heat generation film 4 at the target value. Specifically, the frequency modulation unit 37 once again finely adjusts the frequency based on the frequency that corresponds to the recording material size transmitted from the CPU 32. The current value is changed by changing the impedance ZL2 of the loop L2 using the adjusted frequency. According to this, the surface temperature t1 of the heat generation film 4 may be configured to the target value.

According to the present embodiment, an alternating voltage is supplied in a contactless manner to multiple heat generation elements provided in the heat generation film 4 using the primary coil 1 and the secondary coil 3. In the present embodiment, the loop L2 is provided in the heat generation layer 4*e* among the multiple heat generation elements as the variable impedance circuit in which the impedance changes in response to the frequency. According to the present embodiment, by changing the frequency according to the size of the recording material that is the heating target, it is possible to switch the heat generation amounts of the heat generation layer 4*a* and the heat generation layer 4*b*. The CPU 32, the switching control unit 36, and the like that function as the frequency change unit can vary the amount of power that is supplied to the loop L1, which is the first circuit, and to the loop L2, which is the second circuit, by changing the frequency of the alternating voltage. By employing this kind of circuit, the heat generation amount can be selected according to the size of the recording material without providing a mechanical switch or an electronic switch on the secondary coil 3 side.

In the present embodiment, the length of the heat generation layer 4*b* in the rotating shaft direction of the fixing film 4 is longer than the length of the heat generation layer 4*e* in the rotating shaft direction of the fixing film 4. Also, the capacitance element 18*a* in which the impedance changes according to the frequency is connected to the heat generation layer 4*e*. When the recording material having the first size is to be heated, the frequency change unit configured by the CPU 32 and the like configures the frequency of the alternating voltage that is supplied by the primary coil 1 to the first frequency. Also, when the recording material of the second size that is smaller than the first size is to be heated, the frequency change unit configures the frequency of the alternating voltage to the second frequency that is higher than the first frequency. As a result, the heat generation layer 4*b* generates heat for the first size, and the heat generation layer 4*b* and the heat generation layer 4*e* generate heat for the second size. Accordingly, an excessive temperature increase in the non-paper-feeding region of the fixing film 4 can be suppressed even if recording materials having the second size that is relatively small pass through in succession.

The capacitance element 18*a* is attached to the outer portion of the heat generation film 4, and therefore the task of attachment is simplified. The switching control unit 36 functions as a unit for varying the duty of the alternating voltage applied to the primary coil 1. The frequency that was determined according to the recording material size may be finely adjusted by the frequency modulation unit 37, which is part of the frequency change unit, according to the difference between the value detected by the temperature detection element 17 that functions as a temperature detection unit, and the target value.

According to the present embodiment, excessive temperature increases in the non-paper-feeding region of the fixing film 4 are suppressed, and therefore temperature irregularities in the fixing film 4 can be reduced, and wrinkles in the recording material are less likely to be generated.

Variation 1

The above-described embodiment described an example of selectively switching between one or both of two heat generation elements using the frequency. However, with the present invention, it is possible to alternatively select only one of the two heat generation elements using the frequency. Note that portions that have already been described are denoted by the same reference numerals for the purpose of simplifying the description.

Description of Heat Generation Unit

FIG. 12 shows a cross-sectional structure of a fixing region. A first capacitance element 18*b*, a second capacitance element 18*c*, a first inductor 19*b*, and a second inductor 19*c* are arranged on the passive element holding member 16. The first capacitance element 18*b* and the first inductor 19*b* are connected to the heat generation layer 4*b*. The second capacitance element 18*c* and the second inductor 19*c* are connected to the heat generation layer 4*e*. The connection relationship in the rotating shaft direction of the heat generation film 4 is as follows.

The connection relationship in the heat generation layer 4*b* that corresponds to the B4-size recording material is as described below.

Contact point C2 of the coil 3→conduction layer 4*a*→heat generation layer 4*b*→conduction layer 4*h*→contact point C5→capacitance element 18*b*→inductor 19*b*→contact point C6→conduction layer 4*c* The conduction layer 4*c* is connected to the other contact point C1 of the coil 3.

The connection relationship in the heat generation layer 4*e* that corresponds to the A4-size recording material is as described below.

Contact point C2 of the coil 3→conduction layer 4*f*→heat generation layer 4*e*→conduction layer 4*g*→contact point C7→capacitance element 18*c*→inductor 19*c*→contact point C8→conduction layer 4*c*

As described above, the conduction layer 4*c* is connected to the contact point C1.

Description of Power Supply Circuit

Figure 13A:
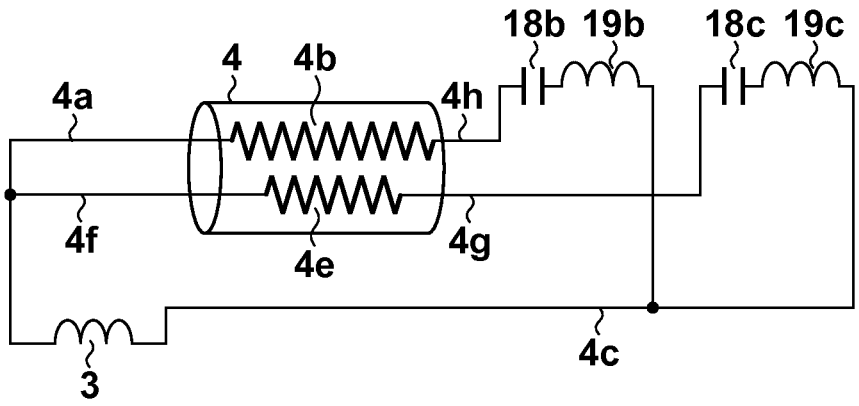
FIGS. 13A and 13B are circuit diagrams of a secondary coil side.
Figure 13B:
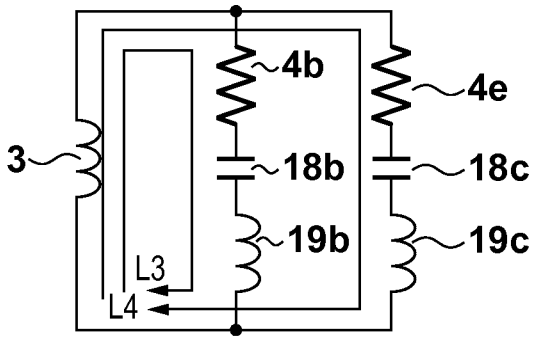

FIGS. 13A and 13B show the equivalence circuit for the heat generation unit. In particular, FIG. 13A shows an equivalence circuit in which the heat generation layers and the like shown in FIG. 12 have been directly replaced with electrical elements. FIG. 13B shows an equivalence circuit that has been rearranged for the description. A description will be given hereinafter with reference to FIG. 13B.

The heat generation film 4 has two circuits. The first closed circuit is a loop L3 that is constituted by the secondary coil 3, the heat generation layer 4*b*, the first capacitance element 18*b*, and the first inductor 19*b*. The second closed circuit is a loop L4 that is constituted by the secondary coil 3, the heat generation layer 4*e*, the second capacitance element 18*c*, and the second inductor 19*c*. The impedance ZL3 of the loop L3 and the impedance ZL4 of the loop L4 are determined using a composite resistance of the resistance components including the heat generation element, and the capacitance elements and the inductors.

The values of passive elements constituting the loops L3 and L4 are assumed to be as follows.

Resistance value R4*b* of heat generation layer 4*b*=10Ω
Resistance value R4*e* of heat generation layer 4*e*=10Ω
Capacitance C18*b* of first capacitance element=0.1 μF
Capacitance C18*c* of second capacitance element=1 μF
Inductance L20*b* of first inductor 20*b*=10 μH
Inductance L20*c* of second inductor 20*c*=100 μH The resonance frequency f of each loop can be obtained by substituting these parameters into $f=2\pi\sqrt{(LC)}$. The resonance frequency f3 of the loop L3 is 160 kHz. The resonance frequency f4 of the loop L4 is 16 kHz.

The heat generation amount of the heat generation unit can be selected by setting the frequency of the current that flows in the primary coil 1 (drive frequency) according to the recording material size to either the resonance frequency f3 or f4. Here, the frequency of the current that flows in the primary coil 1 in the case of using a B4-size recording material is 160 kHz, and the frequency of the current that flows in the primary coil 1 in the case of using an A4-size recording material is 16 kHz.

A case of printing on a B4-size recording material will be described first. When the current of the driving frequency corresponding to the B4 size (160 kHz) flows in the secondary coil 3, the current flows in the heat generation layer 4*b* along the loop L3 and heat is generated. This is because the frequency of the current and the resonance frequency f3 of the loop L3 match. On the other hand, regarding the loop L4, the frequency of the current and the resonance frequency f4 do not match. Accordingly, the impedance ZL4 is approximately 10 times the impedance ZL3 of the loop L3 and only a current that is 10% or less of that of the loop L3 flows in the loop L4. As a result, there is almost no rise in temperature in the heat generation layer 4*e*, and the fixing with respect to the B4-size recording material is executed using the heat generation layer 4*b*.

A case of printing on an A4-size recording material will be described next. When the current of the driving frequency corresponding to A4 size (16 kHz) flows in the secondary coil 3, the current flows in the heat generation layer 4*e* along the loop L4 and heat is generated. This is because the frequency of the current and the resonance frequency f4 of the loop L4 match. On the other hand, regarding the loop L3, the frequency of the current and the resonance frequency f3 do not match. Accordingly, the impedance ZL3 is approximately 10 times the impedance ZL4 of the loop L4 and only a current that is 10% or less of that of the loop L4 flows in the loop L3. As a result, there is almost no rise in temperature in the heat generation layer 4*b*, and the fixing with respect to the A4-size recording material is executed using the heat generation layer 4*e*.

In this way, according to the present embodiment, the loop L3, which is the first circuit, has the first capacitance element 18*b* and the first inductor 19*b*, and the loop L4, which is the second circuit, has the second capacitance element 18*c* and the second inductor 19*c*. A frequency change unit such as the CPU 32 configures the frequency of the alternating voltage supplied by the primary coil 1 to the first frequency f3 when the recording material having the first size is to be heated. Accordingly, mainly the heat generation layer 4*b* generates heat. On the other hand, the frequency change unit sets the frequency of the alternating voltage to the second frequency f4, which is different from the first frequency f4, when the recording material having the second size that is smaller than the first size is to be heated. Accordingly, mainly the heat generation layer 4*e* generates heat.

By changing the frequency in this manner, the heat generation layer that is to generate heat can be selected, and therefore a mechanical switch or the like is not needed on the secondary side. Also, since it is possible to suppress excessive increases in temperature at the ends of the fixing film 4, heating irregularities and wrinkles are less likely to be generated.

Variation 2

The above-described embodiment described the capacitance element as being attached to the exterior of the heat generation film 4, but the capacitance element may be included in the interior of the heat generation film 4.

Figure 14:
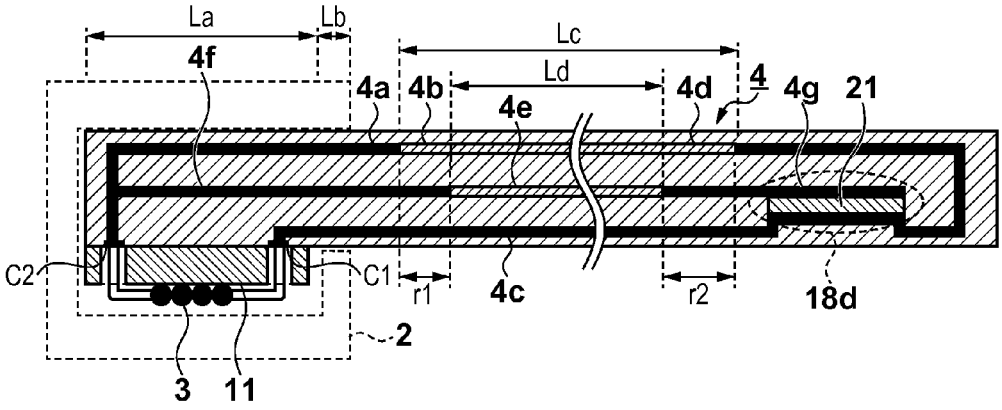
FIG. 14 is a schematic diagram for illustrating a layer configuration of a heat generation film.

FIG. 14 is a cross-sectional diagram showing an example of a capacitance element that is formed on the interior of the heat generation film 4. The capacitance element 18*a* shown in FIG. 5 is layered in the interior of the heat generation film 4 as the capacitance element 18*d* as shown in FIG. 14. The capacitance element 18*d* is constituted by sandwiching a high-permittivity layer 21 between the conduction layer 4*g* and the conduction layer 4*c*. The high-permittivity layer 21 is an insulating sheet for example. This kind of insulating sheet is formed by dispersing a filler with a high relative permittivity using a surface processing agent in order to fill a matrix resin having a film-forming ability. The relative permittivity is 45 for example. In the case of forming a high permittivity layer 21 with a thickness of 10 μm and a width of 4 cm over the entire circumference in the circumferential direction of the heat generation film 4 whose diameter is 300 mm, the capacity of the capacitance element 18*d* is about 0.1 μF. Since it has a withstand voltage of approximately 200 V at the thickness of 10 μm, the insulation of the capacitance element 18*d* will not break down while the fixing apparatus 10 is being driven.

In this way, by including the capacitance element 18*d* as a portion of the layer configuration of the heat generation film 4, it is possible to realize a smaller and more lightweight fixing apparatus 10. Also, the capacitance element 18*d*, which is formed in the interior of the fixing film 4, is fixed on the fixing film 4 more reliably than the capacitance element 18*a*, which is attached to the exterior of the fixing film 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-108370, filed May 22, 2013 which is hereby incorporated by reference herein in its entirety.

What is claimed is:

1. A heating apparatus comprising:

a plurality of heat generation elements provided on a heat generation film;

a non-contact power supply unit configured to supply power in a contactless manner to the plurality of heat generation elements;

a variable impedance circuit electrically connected to at least one of the plurality of heat generation elements, and in which an impedance changes according to the frequency of an alternating voltage supplied by the non-contact power supply unit; and a frequency change unit configured to switch heat generation amounts of the plurality of heat generation elements by changing the frequency according to the size of a recording material that is a heating target.

2. The heating apparatus according to claim 1, wherein the non-contact power supply unit includes:

a power source unit configured to generate an alternating voltage with a predetermined frequency;

a primary coil connected to the power source unit; and a secondary coil inductively coupled with the primary coil, and wherein the variable impedance circuit includes:

a first circuit connected to the secondary coil and including a first heat generation element from among the plurality of heat generation elements; and a second circuit connected to the secondary coil and including a second heat generation element from among the plurality of heat generation elements, and wherein the frequency change unit is configured to vary the power supplied to the first circuit and the second circuit by changing the frequency.

3. The heating apparatus according to claim 2, wherein the length of the first heat generation element in a rotating shaft direction of the heat generation film is longer than the length of the second heat generation element in the rotating shaft direction of the heat generation film, wherein a capacitance element in which an impedance changes according to the frequency is connected to the second heat generation element, and wherein the frequency change unit is configured to configure the frequency of the alternating voltage supplied by the non-contact power supply unit to a first frequency when a recording material having a first size is to be heated, and to configure the frequency of the alternating voltage to a second frequency that is higher than the first frequency, when a recording material having a second size that is smaller than the first size is to be heated.

4. The heating apparatus according to claim 2, wherein the length of the first heat generation element in the rotating shaft direction of the heat generation film is longer than the length of the second heat generation element in the rotating shaft direction of the heat generation film, wherein the first circuit has a first capacitance element and a first inductor, wherein the second circuit has a second capacitance element and a second inductor, and wherein the frequency change unit is configured to configured the frequency of the alternating voltage supplied by the non-contact power supply unit to a first frequency when a recording material having a first size is to be heated, and to configure the frequency of the alternating voltage to a second frequency that is different from the first frequency, when a recording material having a second size that is smaller than the first size is to be heated.

5. The heating apparatus according to claim 3, wherein the capacitance element is attached to the exterior of the heat generation film.

6. The heating apparatus according to claim 3, wherein the capacitance element is provided in the interior of the heat generation film.

7. The heating apparatus according to claim 1, wherein the frequency change unit is configured to vary the duty of the alternating voltage.

8. The heating apparatus according to claim 1, further comprising:

a temperature detection unit configured to detect the temperature of the heat generation film, wherein the frequency change unit is configured to, according to a difference between a value detected by the temperature detection unit and a target value, adjust a frequency determined according to the size of the recording material.

9. An image forming apparatus comprising:

an image forming unit configured to form a toner image on a recording material; and a fixing unit configured to fix the toner image to the recording material by heating the toner image and the recording material, wherein the fixing unit includes:

a plurality of heat generation elements provided on a heat generation film;

a non-contact power supply unit configured to supply power in a contactless manner to the plurality of heat generation elements;

a variable impedance circuit electrically connected to at least one of the plurality of heat generation elements, and in which impedance changes according to the frequency of an alternating voltage supplied by the non-contact power supply unit; and a frequency change unit configured to switch the heat generation amounts of the plurality of heat generation elements by changing the frequency according to the size of the recording material.

* * * * *